US007183711B2

(12) United States Patent
Miyake et al.

(10) Patent No.: US 7,183,711 B2
(45) Date of Patent: Feb. 27, 2007

(54) PLASMA DISPLAY PANEL AND VIDEO DISPLAY SYSTEM EMPLOYING SAME

(75) Inventors: Tatsuya Miyake, Hatoyama (JP); Keizo Suzuki, Kodaira (JP); Masatoshi Shiiki, Musashimurayama (JP); Tsuyoshi Fujita, Yokohama (JP); Seiichi Tsuchida, Yokosuka (JP)

(73) Assignee: Hitachi, Ltd., Tokyo (JP)

( * ) Notice: Subject to any disclaimer, the term of this patent is extended or adjusted under 35 U.S.C. 154(b) by 81 days.

(21) Appl. No.: 11/043,280

(22) Filed: Jan. 27, 2005

(65) Prior Publication Data

US 2006/0049757 A1 Mar. 9, 2006

(30) Foreign Application Priority Data

Sep. 3, 2004 (JP) ..... 2004-257253

(51) Int. Cl.
*H01J 17/49* (2006.01)

(52) U.S. Cl. ..... 313/587; 313/582; 345/60

(58) Field of Classification Search ..... 313/587
See application file for complete search history.

(56) References Cited

U.S. PATENT DOCUMENTS 5,264,758 A * 11/1993 Iijima et al. ..... 313/584
6,130,504 A * 10/2000 Nakayama et al. ..... 313/584
6,333,599 B1 12/2001 Kawanami
6,856,931 B2 * 2/2005 Yoshida ..... 702/127
2004/0119397 A1 * 6/2004 Sakamoto ..... 313/495
2005/0236987 A1 * 10/2005 Okazaki et al. ..... 313/582
2005/0258748 A1 * 11/2005 Kang et al. ..... 313/582
2006/0170355 A1 * 8/2006 Kweon et al. ..... 313/582

FOREIGN PATENT DOCUMENTS

GB 1 4189 044 12/1975
JP 5-121006 5/1993

* cited by examiner

*Primary Examiner*—Nimeshkumar D. Patel
*Assistant Examiner*—Peter Macchiarolo
(74) *Attorney, Agent, or Firm*—Antonelli, Terry, Stout and Kraus, LLP

(57) ABSTRACT

A plasma display panel includes plural discharge cells and a barrier rib layer which defines the discharge cells. Each discharge cells has two opposing electrodes on front and rear substrates, respectively, for generating discharge therebetween, discharge gas and phosphor films. The barrier rib layer is fabricated as a sheet separate from the substrates, is provided with openings each forming a discharge space, and is sandwiched between the substrates. The following relationships are satisfied: $0.1 \leqq S2/S1 \leqq 0.4$; 100 Torr×mm≦pd≦400 Torr×mm; and 0.2 mm≦d, where S1 is an area of a projection of a space occupied by one discharge cell onto the front substrate, S2 is an area of a portion of the front substrate for projecting light from the discharge cell, p is a pressure of the discharge gas, and d is a distance between the electrodes.

20 Claims, 15 Drawing Sheets

LS1a
LS2a
24, 25
a
c
1
2
3
7
7
8
9
10
11
12

PLASMA DISPLAY PANEL AND VIDEO DISPLAY SYSTEM EMPLOYING SAME

CLAIM OF PRIORITY

The present application claims priority from Japanese application serial no. 2004-257253, filed on Sep. 3, 2004, the content of which is hereby incorporated by reference into this application.

BACKGROUND OF THE INVENTION

1. Field of the Invention

The present invention relates to a plasma display panel (hereinafter also referred to as a plasma panel or a PDP), and in particular to a structure of a plasma panel capable of improving a light-room contrast and realizing high luminous efficacy and high-quality display images, a method of manufacturing the plasma panel, a method of driving the plasma panel, and a plasma display apparatus including a driving device in addition to the plasma panel.

2. Description of Prior Art

Recently, plasma display devices have been expected as promising large-size thin color display devices. More specifically, since an ac surface-discharge type PDP generates discharges between electrodes disposed on the same substrate for producing a display and is driven by ac voltages, the ac surface-discharge type PDP is the most common among PDPs put to practical use because of its simple structure and high reliability. The following will explain an example of a conventional ac surface-discharge type PDP.

FIG. 1 is an exploded perspective view illustrating part of a structure of a plasma panel. Formed on an underside of a front glass substrate (a substrate facing a viewing space explained lately) 1 are transparent common electrodes (hereinafter referred to as X electrodes) 22-1, 22-2 and transparent independent electrodes (hereinafter referred to as Y electrodes or scan electrodes) 23-1, 23-2. X bus electrodes 24-1, 24-2 and Y bus electrodes 25-1, 25-2 are overlaid on the X electrodes 22-1, 22-2 and the Y electrode 23-1, 23-2, respectively. Further, the X electrodes 22-1, 22-2, the Y electrodes 23-1, 23-2, the X bus electrodes 24-1, 24-2, and the Y bus electrodes 25-1, 25-2 are covered with an dielectric 2, and then they are covered with a protective film (also called a protective layer) 3 such as magnesium oxide (MgO). The X electrodes 22-1, 22-2 and the Y electrodes 23-1, 23-2, the X bus electrodes 24-1, 24-2, and the Y bus electrodes 25-1, 25-2 are collectively named a display discharge electrode or a display electrode (or a display discharge electrode pair or a display electrode pair, to indicate that they form a pair of X and Y).

In the above, the X electrodes 22-1, 22-2 and the Y electrodes 23-1, 23-2 have been explained as transparent electrodes, this is because a brighter (high-brightness) panel can be obtained, and it is needless to say that they do not always need to be transparent. Magnesium oxide (MgO) is explained as a concrete material for the protective film 3, but material for the protective film 27 is not limited to magnesium oxide. The objects of the protective film 3 are to protect the display discharge electrodes and the dielectric 2 from bombarding ions and to promote initiation and sustenance of discharge with secondary electron emission caused by incident ions. Other materials can be used which are capable of achieving the above objects. The front glass substrate 1 combined in this way with the electrodes, the dielectric and the protective films in an integral structure is called a front plate.

On the other hand, formed on an upside of a rear glass substrate 10 are electrodes (hereinafter referred to as A electrodes or address electrodes) 11 such that they intersect the X electrodes 22-1, 22-2 and the Y electrodes 23-1, 23-2 at right angles with grade separation. The A electrodes 11 are covered with a dielectric 9, and barrier ribs 7 are formed on the dielectric 9 such that they extend in parallel with the A electrodes 11. Further, phosphors 8 are coated on inner surfaces of cavities formed by wall surface of the barrier ribs 7 and the upper surfaces of the dielectric 9. The rear glass substrate 10 combined in this way with the A electrodes and the dielectric 9 in an integral structure is called a rear plate.

A plasma panel is fabricated by bonding together the front and rear plates provided with the necessary constituent elements as described above, filling a gas (a discharge gas) for creating plasma into a space between the front and rear plates, and then sealing the panel. It is needless to say that it is necessary to bond together and seal the front and rear plates to ensure the hermeticity of the sealed package containing the discharge gas.

FIG. 2 is a cross-sectional view of the PDP of FIG. 1 viewed in the direction of the arrow b of FIG. 1, and schematically illustrates three cells which form the smallest unit of pixels. In FIG. 2, borders of the one cell are roughly indicated by broken lines. Hereinafter, cells are also called discharge cells.

In FIG. 2, the A electrode 11 is disposed halfway between the two barrier ribs 7, and the gas (discharge gas) for creating the plasma is contained within a discharge space 12 surrounded by the front glass substrate 1, the rear glass substrate 10 and the barrier ribs 7.

Here, the discharge space means a space where a display discharge for producing a display, an address discharge, or a preliminary discharge (also called a reset discharge) is generated in operation of the plasma panel as described later. More specifically, the discharge space is a space which is filled with the discharge gas, has applied thereacross an electric field necessary for the discharge, and has a spatial expanse required for generation of the discharge. Further, a display discharge space means a space where a display discharge occurs, more specifically, a space which is filled with the discharge gas, has applied thereacross an electric field necessary for a display discharge, and has a spatial expanse required for generation of the display discharge. The discharge space and the display discharge space sometimes mean a space included in each of the discharge cells, and sometimes mean a collection of the spaces included in the discharge cells.

In a color PDP, usually three kinds of phosphors for red, green and blue are coated within the cells, respectively. A trio of cells coated with the three different kinds of phosphors serves as one pixel. A space having a plurality of such cells or pixels arranged continuously and periodically is called a display space. A set is called a plasma display panel or plasma panel which includes the display space and is provided with other necessary structures such as vacuum sealing and electrode leads for external connection. Hereinafter, the plasma panel is also referred to as the PDP.

In the plasma panel, a structure integrally fabricated to seal the discharge gas therein hermetically is referred to as the basic plasma panel. In the basic plasma display panel, a surface from which visible light for display is irradiated is called a display surface, and a space into which the visible light for display is irradiated is called a viewing space.

As described above, in the basic plasma panel, there is a space containing at least the plural discharge cells arranged continuously, which is hereinafter referred to as a display space.

In this specification, the above-defined area S1 is represented by dimensions LS1*a* and LS1*b* in the directions of the arrows *a* and *b*, respectively, and the above-defined area S2 is represented by dimensions LS2*a* and LS2*b* in the directions of the arrows *a* and *b*, respectively. The areas S1 and S2 are indicated by broken lines in relevent ones of the drawings.

Let S1 be an area of a projection of a space occupied by one of the plural discharge cells onto the front substrate 1. Let S2 be an area of a window portion of the front substrate 1 through which the visible light is irradiated from the one of the discharge cells into the outside of the front substrate 1. Let S2/S1 be an area ratio of the display discharge region, an aperture ratio. An area other than the area S2, that is, the area (S1−S2) shall be called a non-aperture area, and its area ratio (S1−S2)/S1 shall be called anon-aperture ratio.

In the conventional plasma panel shown in FIG. 1, the length directions (a direction b) of the barrier ribs 7 are oriented approximately in one direction, and this structure of the plasma panel is called the straight-barrier-rib structure. In another conventional plasma panel, the length directions of the barrier ribs are oriented in at least two directions, and this structure of the plasma panel is called the box-barrier-rib structure.

FIG. 3 is a cross-sectional view of the PDP of FIG. 1 viewed in the direction of the arrow a of FIG. 1, and schematically illustrates two cells. In FIG. 3, borders between the cells are roughly indicated by broken lines. Reference character Wgxy denotes a spacing between the display electrode pair (the X and Y electrodes), and the spacing Wgxy is called a display electrode gap. In FIG. 3, reference numeral 4 denote electrons, 5 is a positive ion, 18 is a positive wall charge, and 6 are negative wall charges.

By way of example, FIG. 3 schematically illustrates that, by applying a negative voltage to the Y electrode 23-1 and a voltage positive with respect to the Y electrode 23-1 to the A electrode 11 and the X electrode 22-1, initially a discharge is generated, and then the discharge has ceased. This has caused formation of a wall charge for assisting in initiation of a discharge between the Y electrode 23-1 and the X electrode 22-1, and this formation of the wall discharge is called "address." In this state, when an appropriate voltage of the polarity opposite from the previous one is applied between the Y electrode 23-1 and the X electrode 22-1, a discharge is generated in the discharge space between the two electrodes through the dielectric 2 (and the protective film 3). After the cessation of the discharge, if the polarity of the voltage applied between the Y electrode 23-1 and the X electrode 22-1 is reversed, a new discharge is generated again. By repeating this process, discharges are generated continuously, and these discharges are called display discharges (or sustain discharges). Such a conventional ac surface-discharge type PDP is disclosed in U.S. Pat. No. 6,333,599.

SUMMARY OF THE INVENTION

In the case of the ac surface-discharge type, since the discharge for producing a display is generated along a surface, improvement of brightness and luminous efficacy requires an increase in the discharge space. The discharge space can be made larger by increasing its aperture ratio, where the aperture ratio is defined as a ratio of an area of a window portion of the front substrate through which display-forming visible light is irradiated into the viewing space, that is, an area of an aperture, to an area of a projection of the display discharge space onto the display surface. However, an increase in the aperture ratio decreases an area usable for a black matrix which fills spaces between the apertures with black opaque material, and a problem arises in that a light-room display contrast ratio is reduced.

In the case of an ac vertical-discharge type, since the discharge for producing a display is generated between electrodes disposed on a pair of opposing substrates supplied with ac voltages, the discharge space can be expanded toward the viewing space, the discharge space can be made larger without increasing the aperture ratio, the light-room display contrast can be increased. However, in that case, the height of barrier ribs surrounding the discharge space needs to be selected to be greater, and consequently, it makes fabrication of the high barrier ribs difficult by using a process which fabricates the barrier ribs on the front or rear plate.

In the case of the ac surface-discharge type PDP including the techniques described in the "Description of Prior Art" section, the aperture ratio is 45% or more. Especially, in the case of a conventional plasma display device of the ALIS (Alternate Lighting of Surfaces) type described in SID 99 DIGEST, pp. 154–157, for example, the aperture ratio is 65% or more.

In an embodiment of the present invention, the light-room display contrast is increased (1) by increasing the discharge space by adopting a two-electrode discharge PDP of the ac vertical-discharge type, and thereby improving the brightness of generated light and the luminous efficacy; and also (2) by limiting the aperture ratio to 40%, and thereby disposing black opaque material in areas other than the apertures. In order to make the discharge space larger, the height of the barrier ribs is selected to be 0.2 mm or more, and a layer of the barrier ribs is fabricated separately from the front and rear plates. Phosphor films are coated on the layer of the barrier ribs before the layer of the barrier ribs is attached to the front or rear plate, and consequently, this configuration can suppress degradation of the protective layer which is caused in its conventional fabrication process.

The following will explain the summary of the representative ones of the inventions disclosed in this specification.

(1) A plasma display panel including a plurality of discharge cells and a barrier rib layer which defines said plurality of discharge cells; each of said plurality of discharge cells comprising: two opposing electrodes disposed on inner surfaces of opposing front and rear substrates, respectively, for generating discharge between said front and rear substrates for forming a display; dielectric films for covering said two opposing electrodes at least partially; discharge gas; and a phosphor film for generating visible light by being excited by ultraviolet rays produced by said discharge of said discharge gas, wherein said barrier rib layer is fabricated in a form of a sheet separate from said front and rear substrates, is provided with a plurality of openings each of which forms a discharge space in each of said plurality of discharge cells, with walls of said plurality of openings being coated with said phosphor film, and is sandwiched between said front and rear substrates, wherein a relationship of $0.1 \leqq S2/S1 \leqq 0.4$ is satisfied, where S1 is an area of a projection of a space occupied by one of said plurality of discharge cells onto said front substrate, S2 is an area of a window portion of said front substrate through which the visible light is irradiated from said one of said plurality of discharge cells into an outside of said front substrate, and wherein relationships of 100 Torr×mm≦pd≦400 Torr×mm and 0.2 mm≦d are satisfied, where p is a pressure of said discharge gas, and d is a distance between said two opposing electrodes.

(2) A plasma display panel according to (1), wherein said plurality of openings are in a pattern of stripes.

(3) A plasma display panel according to (1), wherein said plurality of openings are in a pattern of stripes.

(4) A plasma display panel according to (1), wherein said two opposing electrodes have applied therebetween a voltage of an effective value equal to or smaller than 300 V for sustaining said discharge for forming a display.

(5) A plasma display panel according to (1), further comprising black opaque members, wherein said black opaque members are disposed between said window portions of said front substrate and on a surface of said barrier layer facing toward said front substrate.

(6) A plasma display panel according to (2), further comprising black opaque members, wherein said black opaque members are disposed between said window portions of said front substrate and on a surface of said barrier layer facing toward said front substrate.

(7) A plasma display panel according to (3), further comprising black opaque members, wherein said black opaque members are disposed between said window portions of said front substrate and on a surface of said barrier layer facing toward said front substrate.

(8) A plasma display panel according to (1), wherein said walls of said plurality of openings are tilted from a normal to said front substrate.

(9) A plasma display panel according to (2), wherein said walls of said plurality of openings are tilted from a normal to said front substrate.

(10) A plasma display panel according to (3), wherein said walls of said plurality of openings are tilted from a normal to said front substrate.

(11) A plasma display panel according to (1), wherein said discharge gas contains a xenon gas, and a xenon proportion aXe in said discharge gas is in a range of from 0.12 to 0.3, where said xenon proportion aXe=nXe/ng, ng is a volume particle (atom or molecule) density of said discharge gas, and nxe is a volume particle density of said Xe gas.

(12) A plasma display panel according to (4), wherein said discharge gas contains a xenon gas, and a xenon proportion aXe in said discharge gas is in a range of from 0.12 to 0.3, where said xenon proportion aXe=nXe/ng, ng is a volume particle (atom or molecule) density of said discharge gas, and nXe is a volume particle density of said Xe gas.

(13) A plasma display panel according to (1), wherein a coefficient of thermal expansion of material of which said barrier rib layer is comprised is in a range of from 80% to 99% of those of said front and rear substrate.

(14) A plasma display panel according to (1), wherein said barrier rib layer is provided with at least one slit in a major surface thereof.

(15) A plasma display panel according to (2), wherein said barrier rib layer is provided with at least one slit in a major surface thereof.

(16) A plasma display panel according to (3), wherein said barrier rib layer is provided with at least one slit in a major surface thereof.

(17) A plasma display panel according to (1), further comprising visible-light non-reflective layers, wherein said visible-light non-reflective layers are disposed on said rear substrate and ones of said two opposing electrodes formed on said rear substrate within said discharge cells, visible from a side of said front substrate.

(18) A plasma display panel according to (1), further comprising ultraviolet-ray-reflective and visible-light-reflective layers, wherein said ultraviolet-ray-reflective and visible-light-reflective layers are disposed on said rear substrate and ones of said two opposing electrodes formed on said rear substrate within said discharge cells, visible from a side of said front substrate.

(19) A plasma display panel according to (1), wherein a non-opening area reflectance is 80% or more, where a display discharge space boundary surface is a solid wall surrounding a display discharge space in which said discharge for forming a display is generated, a discharge opening area is a portion of said display discharge space boundary surface through which the visible light is irradiated into an outside of said front substrate, a non-opening area is an area of said display discharge space boundary surface other than said discharge opening area, and said non-opening area reflectance is an average surface reflectance of said non-opening area to white light.

(20) A video display system employing said plasma display panel according to (1).

The present invention is capable of realizing a plasma panel display which exhibits a high luminous efficacy in terms of a display set (which provides a high-brightness image display with a low power consumption) and a high light-room display contrast.

BRIEF DESCRIPTION OF THE DRAWINGS

In the accompanying drawings, in which like reference numerals designate similar components throughout the figures, and in which:

FIG. 4(*b*) is an exploded perspective view of part of a PDP in accordance with another example of the present invention;

FIG. 6(*b*) is a graph showing a relationship of the ultraviolet ray production efficiency and the sustain voltage Vs versus the Xe proportion;

FIG. 6(*c*) is a graph showing a relationship of relative display luminance and display contrast versus the aperture ratio in the prior-art ac surface-discharge type plasma display panel, and a relationship of the display contrast versus the aperture ratio with the product pd as a parameter in the ac vertical-discharge type plasma display panel in accordance with the present invention;

DETAILED DESCRIPTION OF THE PREFERRED EMBODIMENTS

Figure 1:
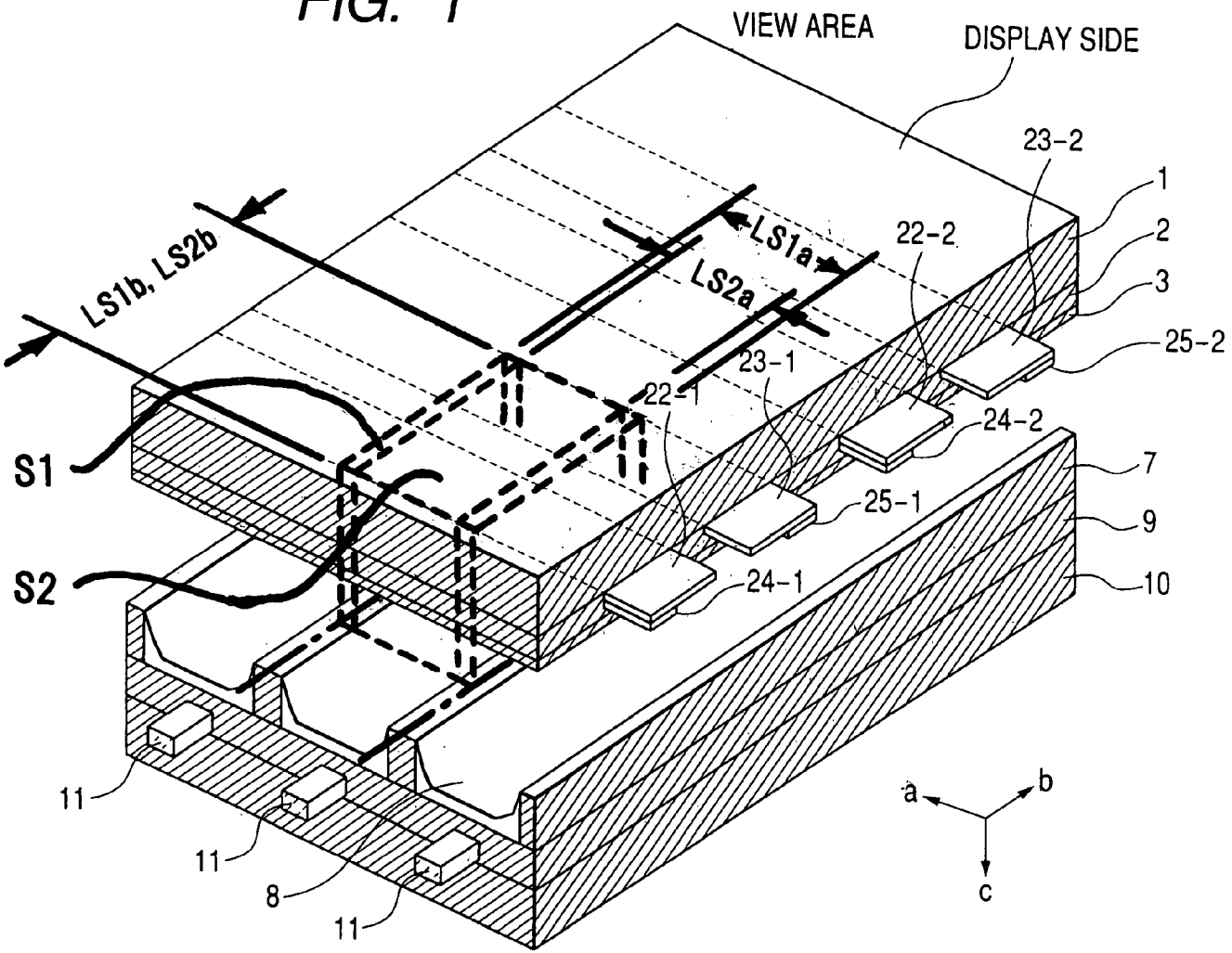
FIG. 1 is an exploded perspective view illustrating part of a structure of a prior art ac surface-discharge type PDP plasma panel.

In the following, the embodiments in accordance with the present invention will be explained in detail by reference to the drawings. The same reference numerals or characters designate functionally similar parts or portions throughout the figures, and repetition of their explanation is omitted.

Embodiment 1

Figure 4A:
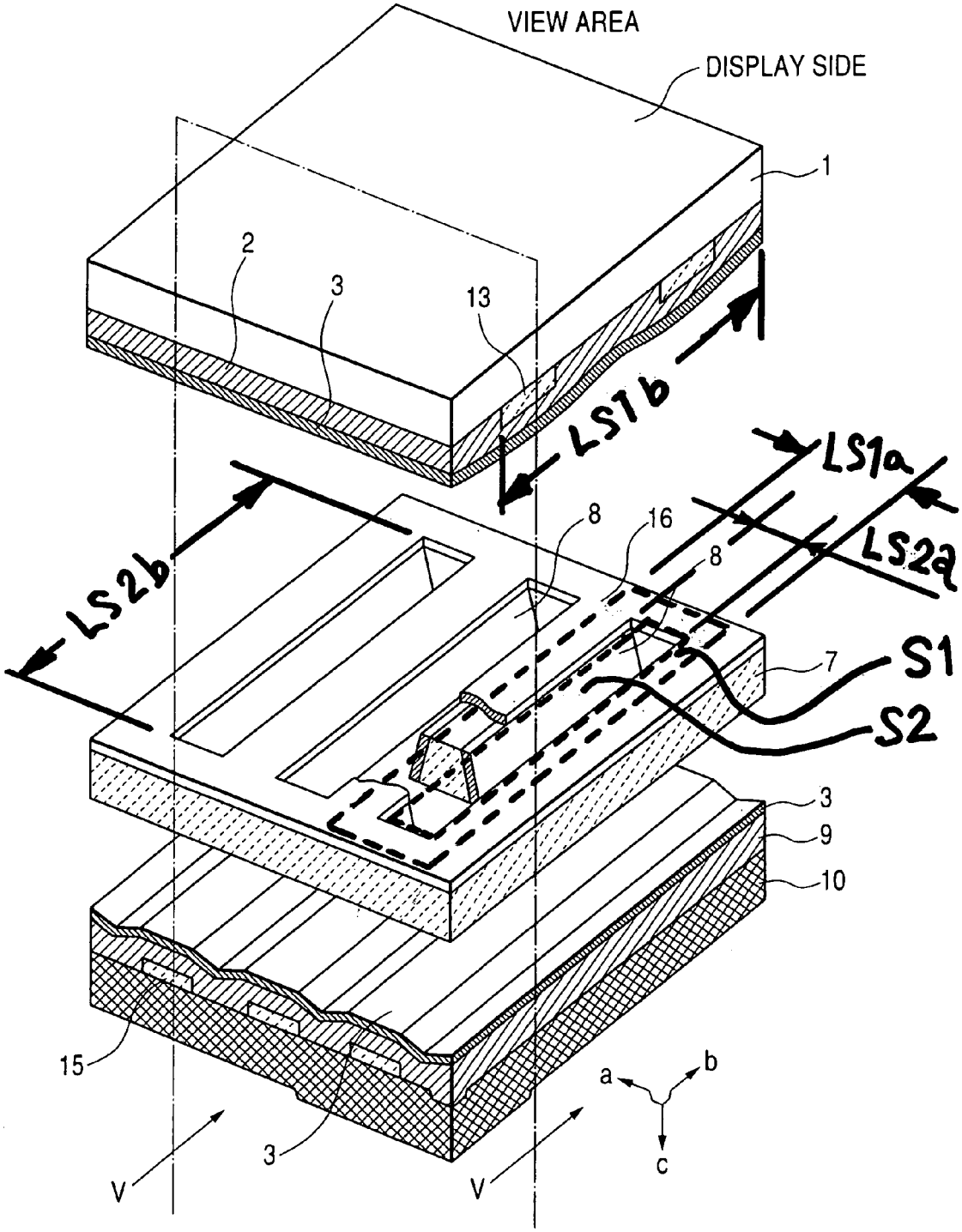
FIG. 4(*a*) is an exploded perspective view of part of a PDP in accordance with an example of the present invention.
Figure 4B:
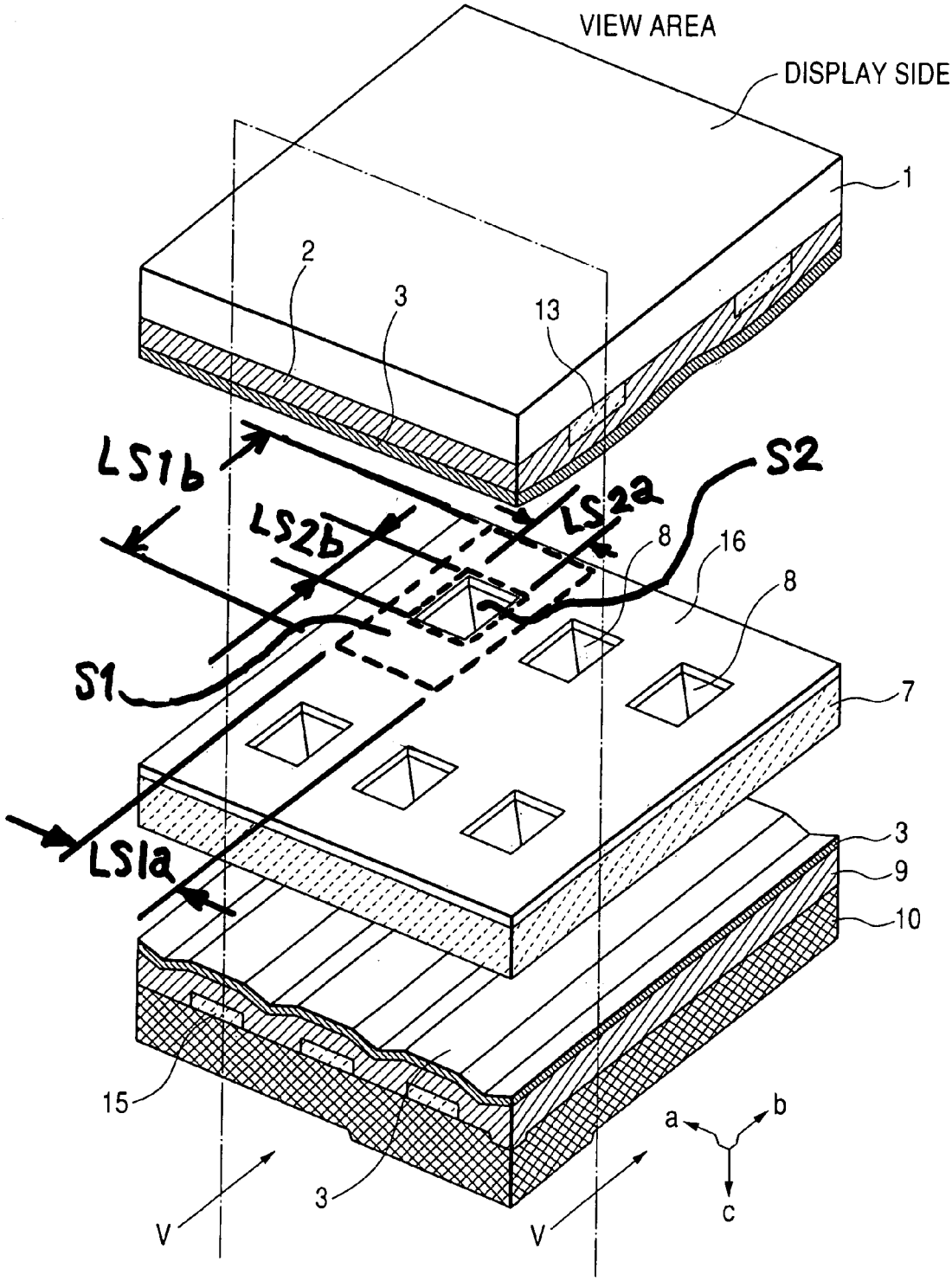

FIG. 4(*a*) is an exploded perspective view of an embodiment of the plasma display panel in accordance with the present invention. Scan electrodes 13 are fabricated so as to extend in a direction of an arrow b on a front plate 1, a dielectric 2 is disposed to cover the scan electrodes 13, and then a protective layer 3 is disposed to cover the dielectric 2.

Figure 2:
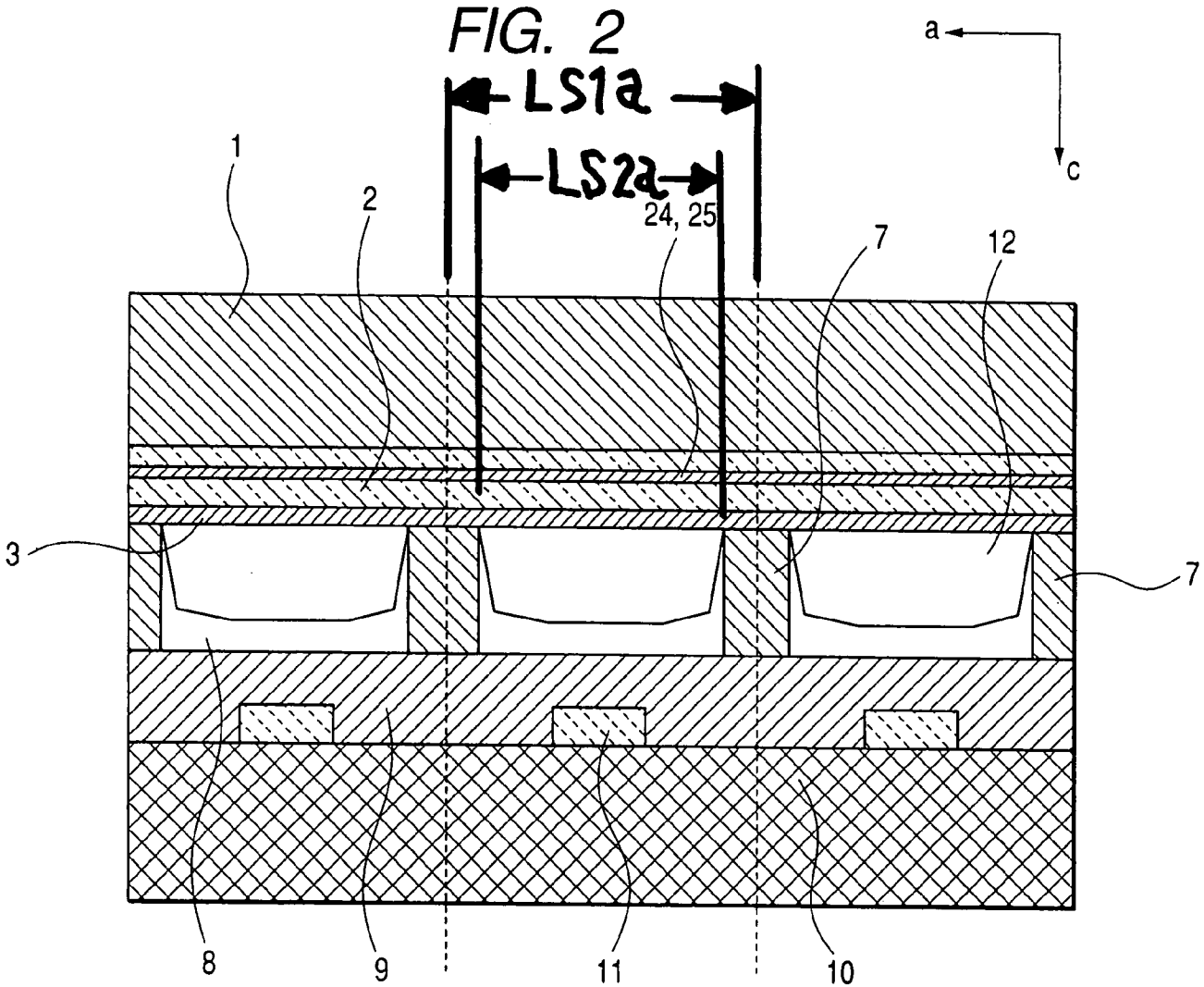
FIG. 2 is a cross-sectional view of the structure of the PDP of FIG. 1 viewed in the direction of the arrow b of FIG. 1.
Figure 3:
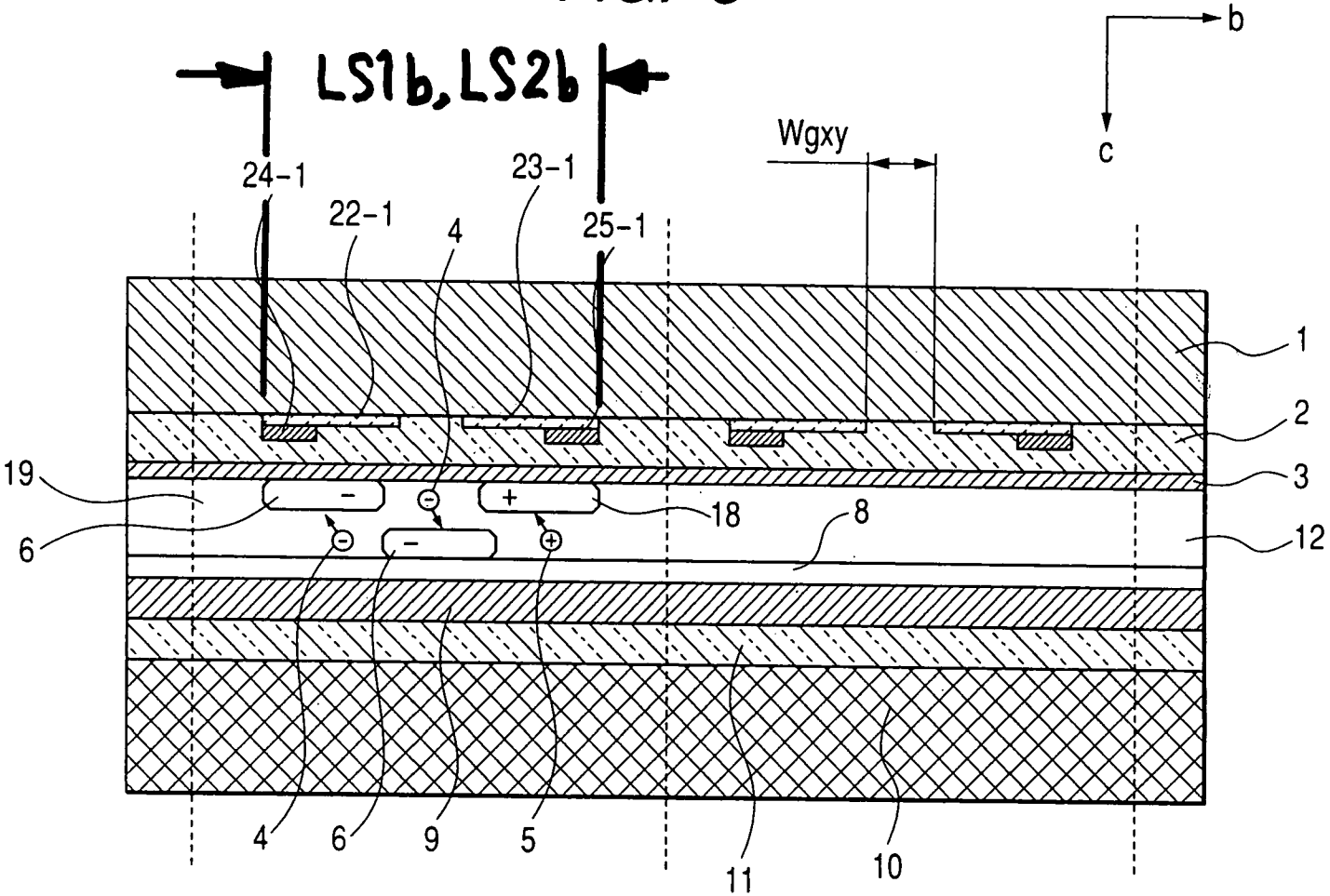
FIG. 3 is a cross-sectional view of the structure of the PDP of FIG. 1, perpendicular to that of FIG. 2.
Figure 5:
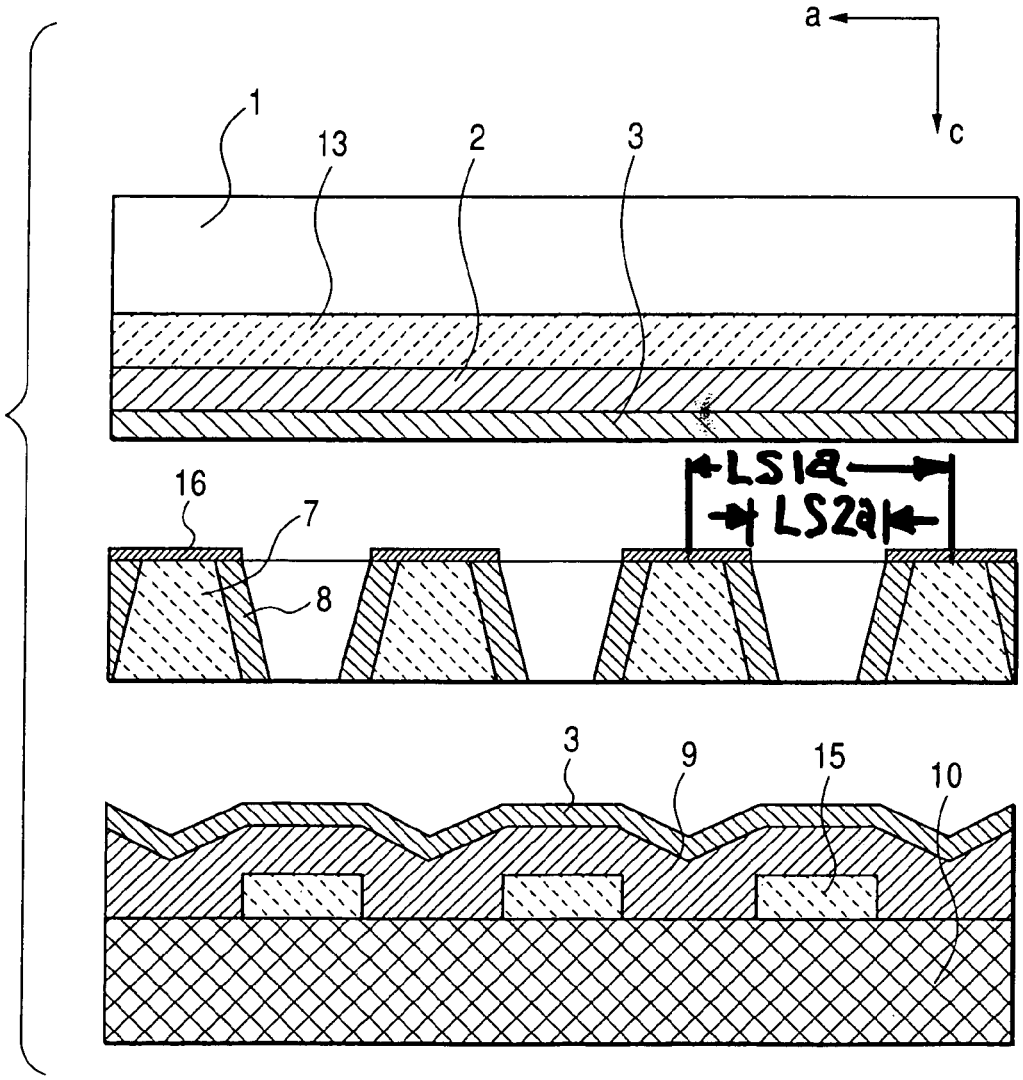
FIG. 5 is a cross-sectional view of the PDPs of FIGS. 4(*a*) and 4(*b*) taken along line V—V of FIGS. 4(*a*) and 4(*b*)

An integral structure comprised of the front substrate 1, the scan electrodes 13, the dielectric 2 and the protective layer 3 is hereinafter referred to as a front plate. A barrier rib plate 7 is provided with apertures in the form of stripes or grids. Phosphors 8 are coated on the wall surfaces of the apertures, and a black matrix 16 is formed on the top surface of the barrier rib plate 7. FIG. 4(*a*) is an exploded perspective view of an example of the PDP employing the barrier rib plate 7 provided with the apertures in the form of stripes, and FIG. 4(*b*) is an exploded perspective view of an example of the PDP employing the barrier rib plate 7 provided with the apertures in the form of grids. The black matrix 16 is comprised of black opaque material, defines a window portion (an aperture) of the front substrate 1 through which the visible light is irradiated from each of the discharge cells into the outside of the front substrate 1, and fills spaces between the window portions (the aperture portions) with the black opaque material. The barrier rib plate 7 is a glass plate comprised of much the same material as that of the front and rear substrates 1, 10, and is fabricated as by a sandblasting method, a screen printing method, a method by using a photosensitive material for barrier ribs, or a machining method. The black matrix 16 can be fabricated by mixing a metal such as chromium, or carbon as pigments into glass material. The rear plate 10 is fabricated as follows. Data electrodes 15 are fabricated so as to extend in a direction of an arrow b on a rear plate 10, a dielectric 9 is disposed to cover the data electrodes 15, and then a protective layer 3 is disposed to cover the dielectric 9. FIG. 5 is a cross-sectional view of the PDP illustrated in FIGS. 4(*a*) and 4(*b*) viewed in the direction of an arrow b of FIGS. 4(*a*) and 4(*b*), and taken along line V—V therein before the PDP is assembled. While the wall surfaces of the plural apertures in the barrier rib plates 7 are perpendicular to the front plate 10 in FIG. 2, in this embodiment the wall surfaces of the plural apertures in the barrier rib plates 7 are tilted from the normal to the front plate 10 as shown in FIG. 5, and consequently, the visible light generated on the surface of the phosphors 8 can be irradiated efficiently into the viewing space.

Assembling of the plasma panel is carried out as follows. Initially, an adhesive agent (not shown) such as frit glass is disposed at a peripheral portion of one of the front plate 1 and the rear plate 10, and then the three layers comprised of the front plate 1, the barrier rib plate 7 and the rear plate 10 are stacked and hermetically sealed such that mutually opposing scan electrodes 13 and data electrodes 15 are perpendicular to each other. Next, after removing impurities remaining at a p-tube (for exhausting and filling of gases) provided at a periphery of the plasma panel, the plasma panel is evacuated to vacuum, thereafter are filled with rare gases for discharges, and then the p-tube is sealed off.

In this embodiment the gas contains a xenon (Xe) gas. Let ng be a volume particle (atom or molecule) density of the discharge gas, and let nXe be a volume particle density of the Xe gas, and let a Xe proportion, aXe, in the discharge gas be nXe/ng. In this embodiment, the Xe proportion, aXe, in the discharge gas is selected to be 0.12 or more. It is very important for increasing a luminous efficacy of the plasma display devices to increase an ultraviolet ray production efficiency by discharge. Methods for increasing the ultraviolet ray production efficiency of the plasma display device are basically divided into following two kinds of techniques: (1) increasing of the Xe proportion aXe of the discharge gas; and (2) increasing of the product pd in discharge, where the product pd is a product of the pressure p of the discharge gas and a distance d between the discharge electrodes.

Figure 6A:
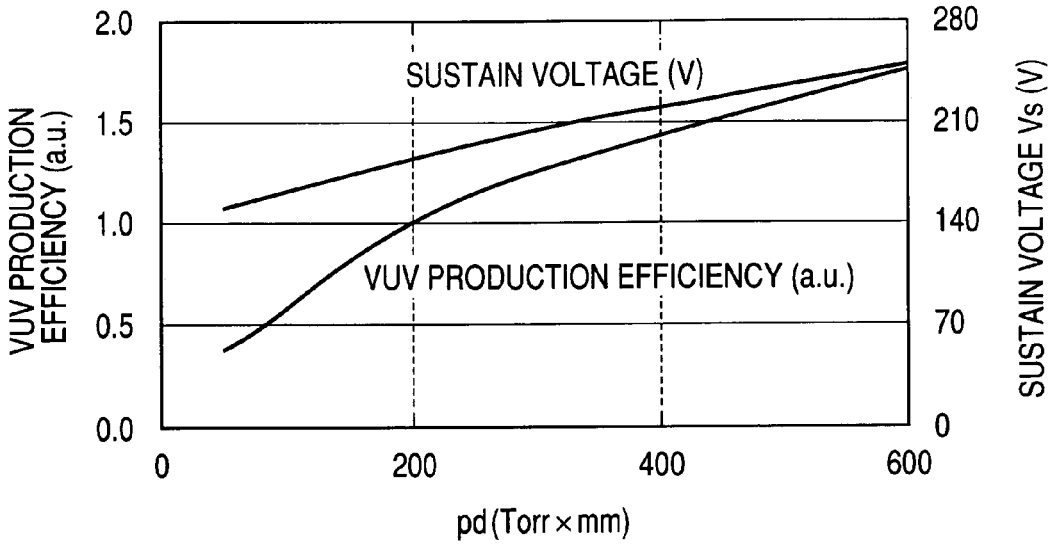
FIG. 6(*a*) is a graph showing a relationship of the ultraviolet ray production efficiency and the sustain voltage Vs versus the product pd.
Figure 6B:
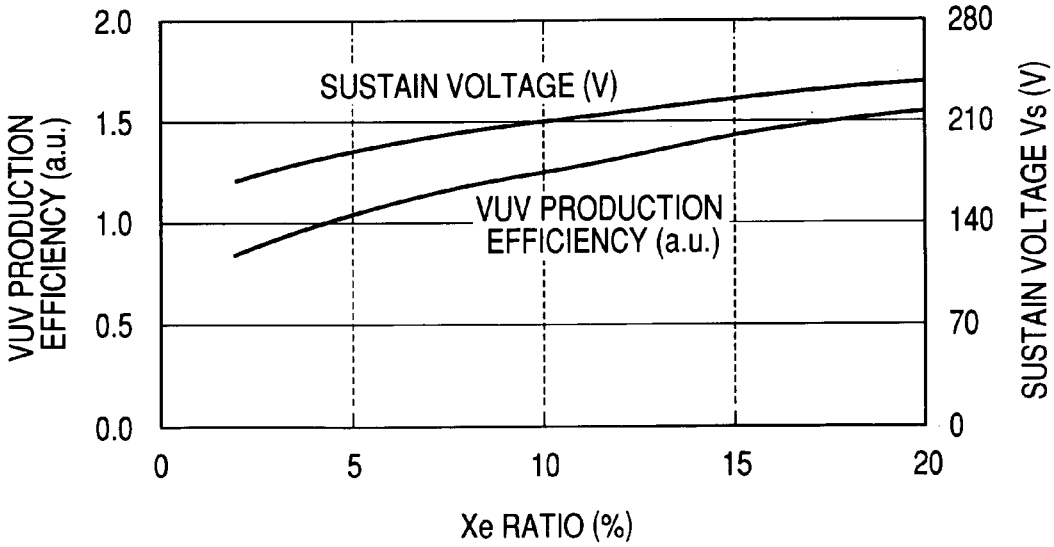

FIGS. 6(*a*) and 6(*b*) show the above effects in terms of relative values of the ultraviolet ray production efficiencies. FIG. 6(*a*) shows the ultraviolet ray production efficiencies and sustain (display discharge) voltages Vs when the product pd is varied at the Xe proportion aXe=4%, and FIG. 6(*b*) shows the ultraviolet ray production efficiencies and sustain (display discharge) voltages Vs when the Xe proportion aXe is varied for the product pd=200 Torr×mm. Here, the sustain (display discharge) voltage Vs is an effective voltage to be applied between the display electrodes for sustaining a display discharge.

In the conventional PDPs, the Xe proportion aXe is usually selected to be in a range of from 4% to 10%. In this embodiment, the ultraviolet ray production efficiency is improved by increasing the Xe proportion aXe further to 12% or more. Since increasing of the Xe proportion aXe is accompanied by an increase in the sustain (display discharge) voltage Vs, it is preferable to select the Xe proportion axe to be 30% or less.

The pressure p of the discharge gas is usually 500 Torr. In the case of the conventional ac surface-discharge type PDPS, the distance between the discharge electrodes is approximately 0.1 mm, the product pd in FIG. 6(*a*) is 50

Torr×mm. FIG. 6(*a*) shows that increasing of the distance d between the discharge electrodes increases the luminous efficacy. However, in the conventional PDPS, since the distance d between the discharge electrodes can be increased only by increasing the distance in parallel with the surface of the substrate, it is impossible to increase the distance d without increasing the pitch between cells. On the other hand, in the case of the ac vertical-discharge type PDPS, since the distance d between the discharge electrodes can be increased in a direction perpendicular to the substrate of the plasma panel, the distance d between the discharge electrodes can be increased to 0.2 mm or more without changing the pitch between cells forming the pixels, and consequently, the luminous efficacy of the PDPs can be improved.

Here, let S1 be an area of a projection of a space occupied by one of the plural discharge cells onto the front substrate 1, let S2 be an area of a window portion of the front substrate 1 through which the visible light is irradiated from the one of the discharge cells into the outside of the front substrate 1, and S2/S1 shall be called an aperture ratio.

Shown by broken lines in FIG. 6(*c*) are a relationship between relative luminance and aperture ratios and a relationship between display contrast ratios and aperture ratios in the case of a conventional ac surface-discharge type PDPs. Shown by solid lines in FIG. 6(*c*) are relationships between relative luminance and aperture ratios with the product pd as a parameter obtained from plural PDPs of the ac vertical-discharge type. A relationship between display contrast ratios and aperture ratios in the case of the ac vertical-discharge type PDPs is similar to that in the case of the conventional ac surface-discharge type PDPS, and the plotting of the contrast relationship for the ac vertical-discharge type PDPs is omitted, and is substituted by that for the ac surface-discharge type PDPs.

Conventionally, the aperture ratio S2/S1 was usually 0.45 or more, and the aperture ratio S2/S1 for the above-explained ALIS type PDPs was 0.65 or more. However, in the present embodiment, the aperture ratio S2/S1 is selected to be in a range of from 0.1 to 0.4 for the purpose of improving the display contrast ratio, and as a result the reduction in display luminance is inevitable. To eliminate this problem, the present embodiment optimizes the above-mentioned product pd. To facilitate the optimizing of the product pd the present embodiments adopts the ac vertical-discharge type in which two electrodes for generating a display discharge are disposed on two opposing substrates, respectively. As is clear from FIG. 6(*c*), higher display luminance can be obtained by selecting the product pd to be larger. Further, in the present embodiment adopting the ac vertical-discharge type, since the product pd can be selected to be larger without being limited by the cell pitch of pixels as already explained, the distanced between the opposing electrodes is selected to be 0.2 mm or more, and the product pd is selected to be in a range of from 100 Torr×mm to 400 Torr×mm. The lower limit of the product pd is selected to secure display luminance at least approximately equal to that obtained by the conventional plasma display panels, and the upper limit of the product pd is selected to prevent the above-described sustain (display discharge) voltages Vs from becoming excessively higher (for example, 300 V). This embodiment is capable of realizing a plasma panel improved the light-room contrast and the luminous efficacy by employing the above-explained configuration satisfying the region hatched in FIG. 6(*c*).

Figure 7:
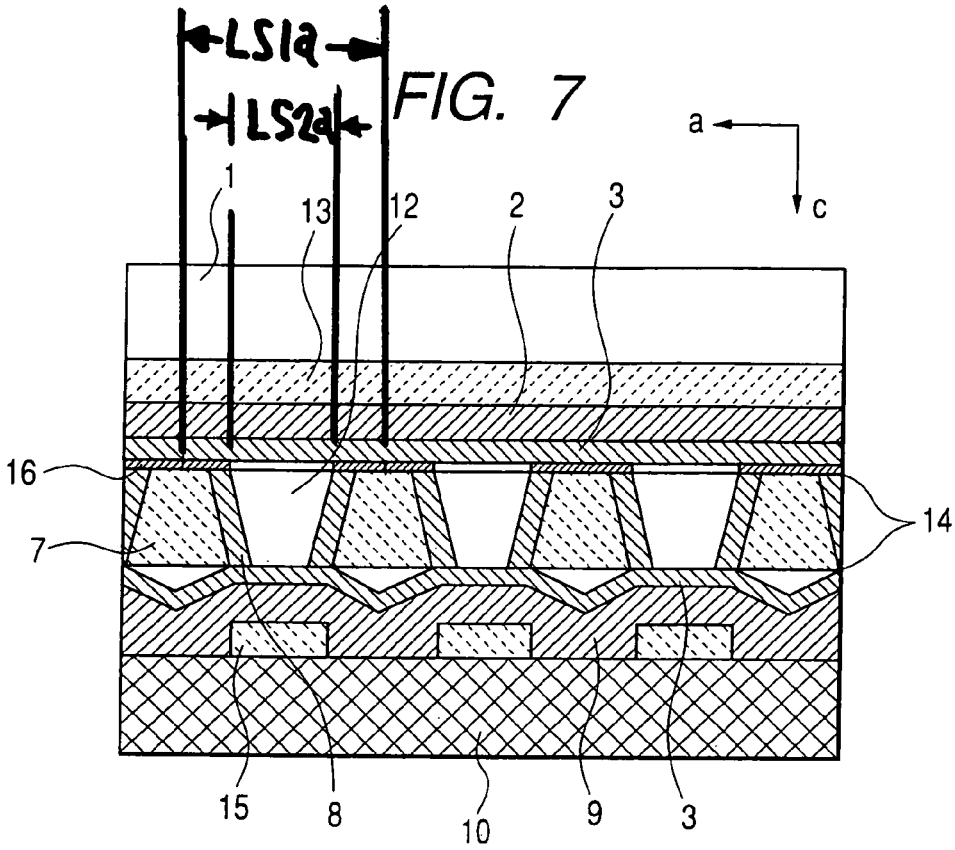
FIG. 7 is a cross-sectional view of the PDP of FIGS. 4(*a*) and 4(*b*) in the assembled state, taken along line V—V of FIGS. 4(*a*) and 4(*b*)

FIG. 7 is a cross-sectional view of the plasma display panel in the assembled state, taken along line V—V, viewed in the direction of the arrow b of FIGS. 4(*a*) and 4(*b*). The barrier rib plate 7 may be merely sandwiched between the front plate 1 and the rear plate 10, or the barrier rib plate 7 may be bonded between the front plate 1 and the rear plate 10 with heat-fusing layers 14 interposed therebetween.

Embodiment 2

Before explaining this embodiment, the difference between the ac surface-discharge type plasma panel and the ac vertical-discharge type plasma panel will be explained by reference to FIGS. 8 to 11.

Figure 8:
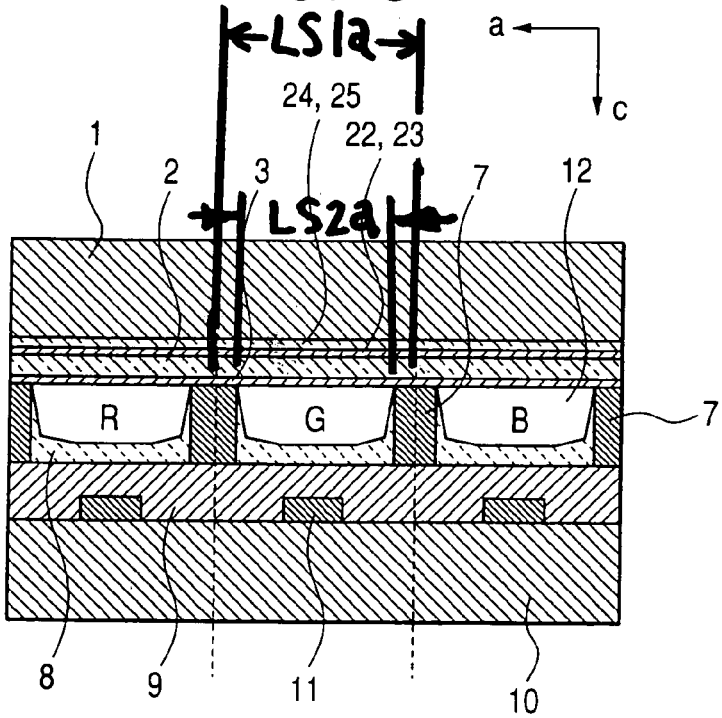
FIG. 8 is a cross-sectional view of one pixel in the structure of the ac surface-discharge type PDP.
Figure 9:
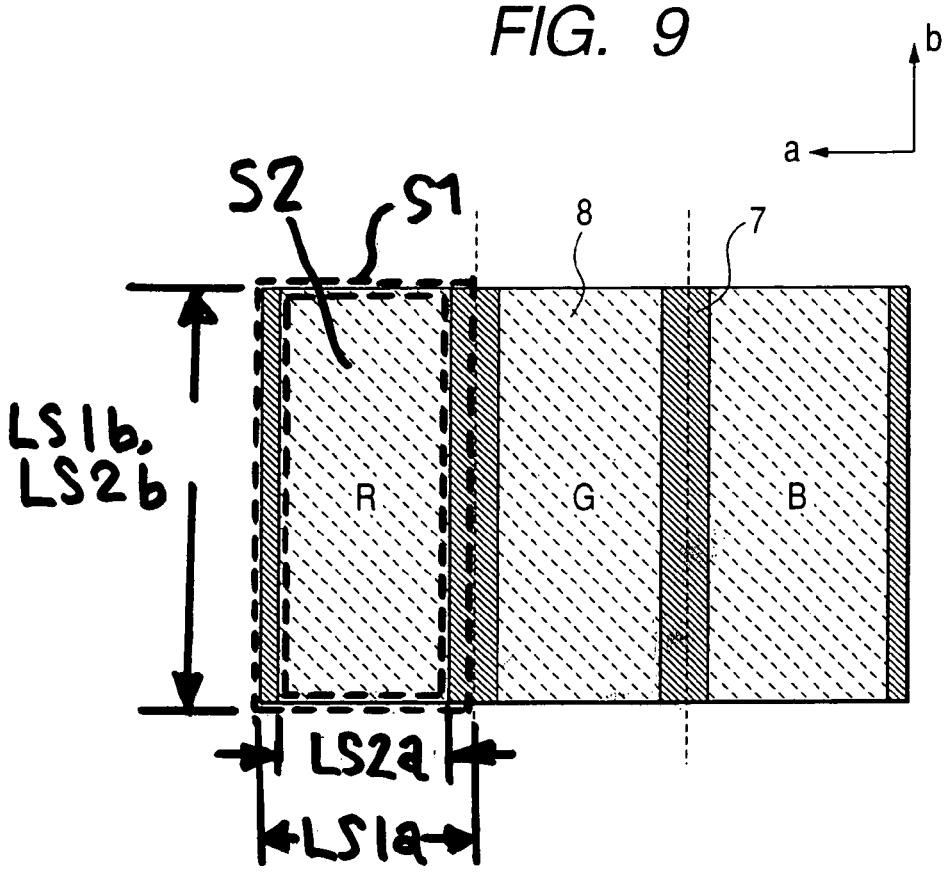
FIG. 9 is a plan view looking down at the PDP of FIG. 8.

FIG. 8 is a cross-sectional view of one pixel comprised of three discharge cells for three primary colors of red (R), green (G) and blue (B), respectively, in the ac surface-discharge type plasma panel. FIG. 9 is a plan view looking down at an arrangement of the barrier rib plate 7 and phosphors 8 of the ac surface-discharge type plasma panel of FIG. 8.

Figure 10:
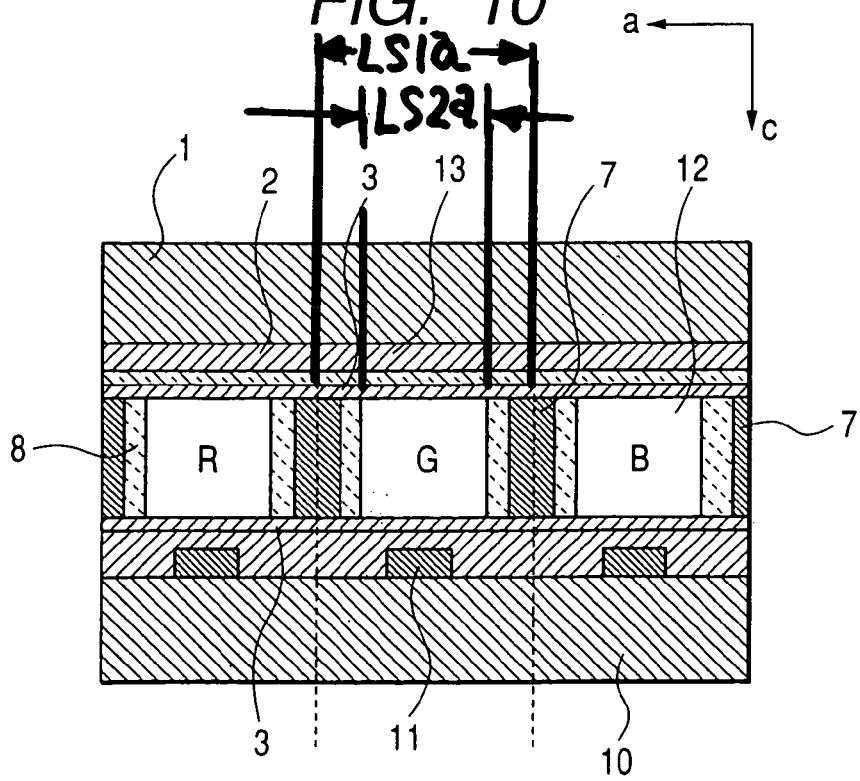
FIG. 10 is a cross-sectional view of one pixel in the structure of the ac vertical-discharge type PDP.
Figure 11:
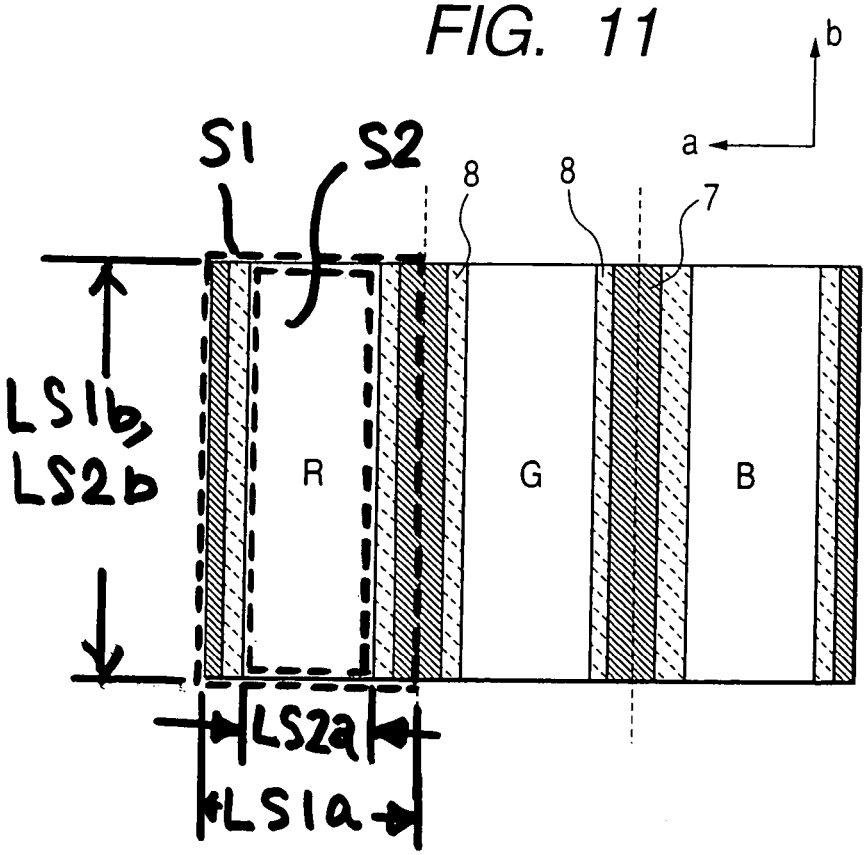
FIG. 11 is a plan view looking down at the PDP of FIG. 10.

FIG. 10 is a cross-sectional view of one pixel comprised of three discharge cells for three primary colors of red (R), green (G) and blue (B), respectively, in the ac vertical-discharge type plasma panel. FIG. 11 is a plan view looking down at an arrangement of the barrier rib plate 7 and phosphors 8 of the ac vertical-discharge type plasma panel of FIG. 10. The ac vertical-discharge type plasma panel makes possible reduction of the areas occupied by the phosphors 8 which appear white even when the discharges are not generated, and consequently, the ac vertical-discharge type plasma panel is capable of providing a higher light-room display contrast than that provided by the ac surface-discharge type plasma panel.

Figure 12:
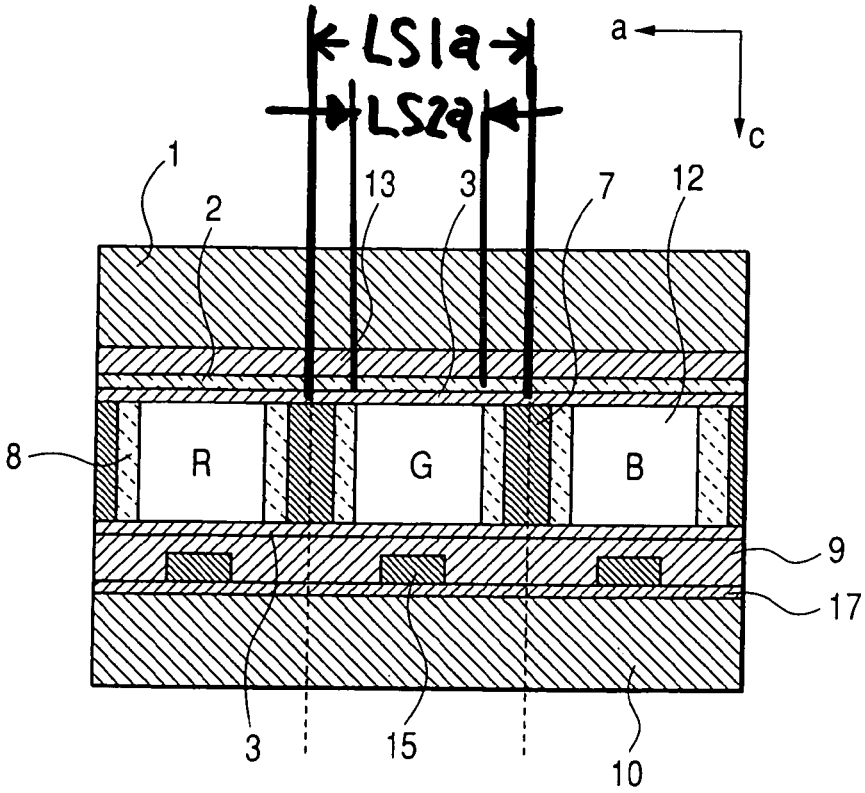
FIG. 12 is a cross-sectional view of an example of the structure of the ac vertical-discharge type PDP in accordance with another example of the present invention.
Figure 13:
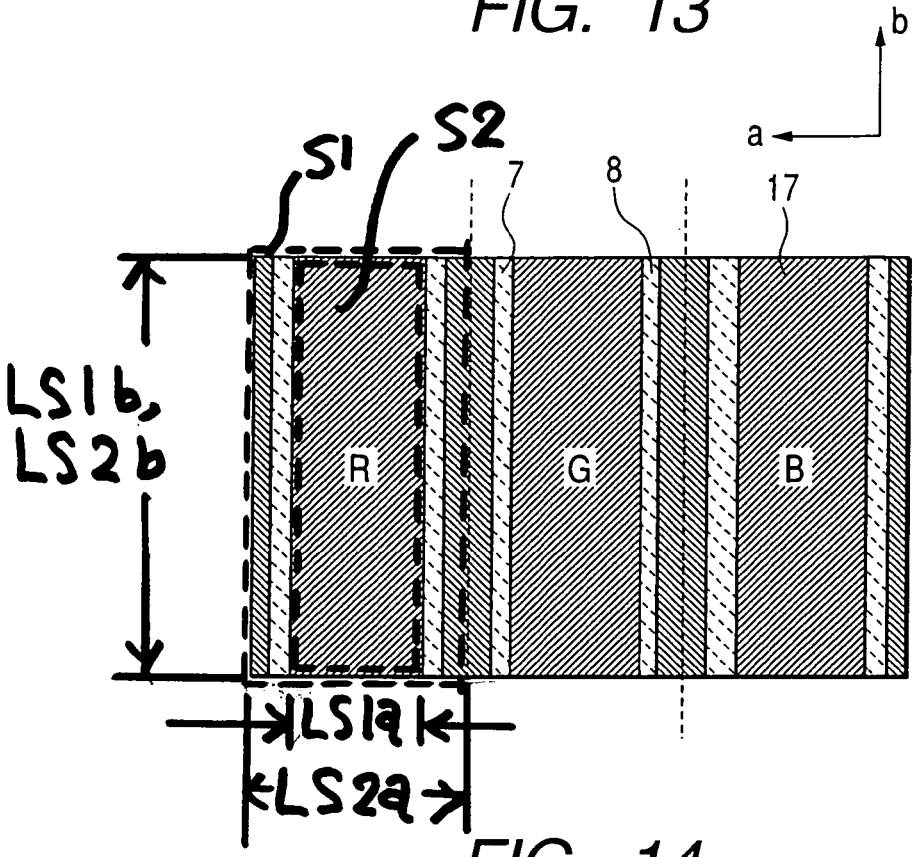
FIG. 13 is a plan view looking down at the PDP of FIG. 12.

FIG. 12 illustrates this embodiment in accordance with the present invention, and is a cross-sectional view of the ac vertical-discharge type plasma panel provided with a visible-light non-reflective layer 17 on the rear plate 10 and the data electrodes 15 within the discharge cells, visible from the viewing space for the purpose of improving the light-room display contrast when the discharge cells are not lit. The visible-light non-reflective layer 17 can be fabricated by mixing a dielectric material used for protection of the electrodes 15 with chromium or carbon. FIG. 13 is a plan view looking down at an arrangement of the barrier rib plate 7, phosphors 8 and the visible-light non-reflective layer 17 of the ac vertical-discharge type plasma panel of FIG. 12. In this case, the light-room display contrast is improved compared with the case illustrated in FIG. 11. Further, the display luminance and the luminous efficacy can be improved by employing an ultraviolet-ray and visible-light reflective layer instead of the visible-light non-reflective layer 17. The ultraviolet and visible-light reflective layer can be fabricated by mixing a dielectric material with titanium, zinc or the like. Further, the display luminance and the luminous efficacy can also be further improved by disposing the ultraviolet-ray and visible-light reflective layer under the phosphor layer 8 (not shown, between the barrier rib plate 7 and the phosphors 8).

Here, let a display discharge space boundary surface be a solid wall surrounding a display discharge space in which the ac vertical-discharge for display is generated. Let a discharge opening area be a portion of the display discharge space boundary surface through which display-forming visible light is irradiated into the outside of the front plate. Let a non-opening area be the area of the display discharge space boundary surface other than the discharge opening area. Let a non-opening area reflectance be an average surface reflectance of the non-opening area to white light. The luminous efficacy was greatly improved by selecting the non-opening area reflectance to be 80% or more. Here, white light is visible light wavelengths of which range from 400 nm to 700 nm, the surface reflectances of the surfaces of the electrodes and the phosphors differ from each other, and therefore they are averaged.

Figure 14:
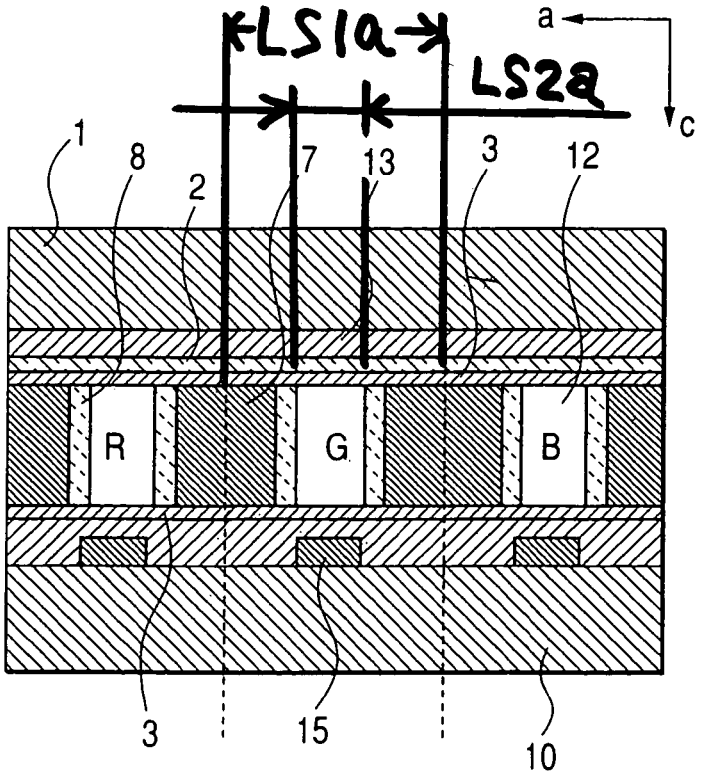
FIG. 14 is a cross-sectional view of an example of the structure of the ac vertical-discharge type PDP in accordance with still another example of the present invention.
Figure 15:
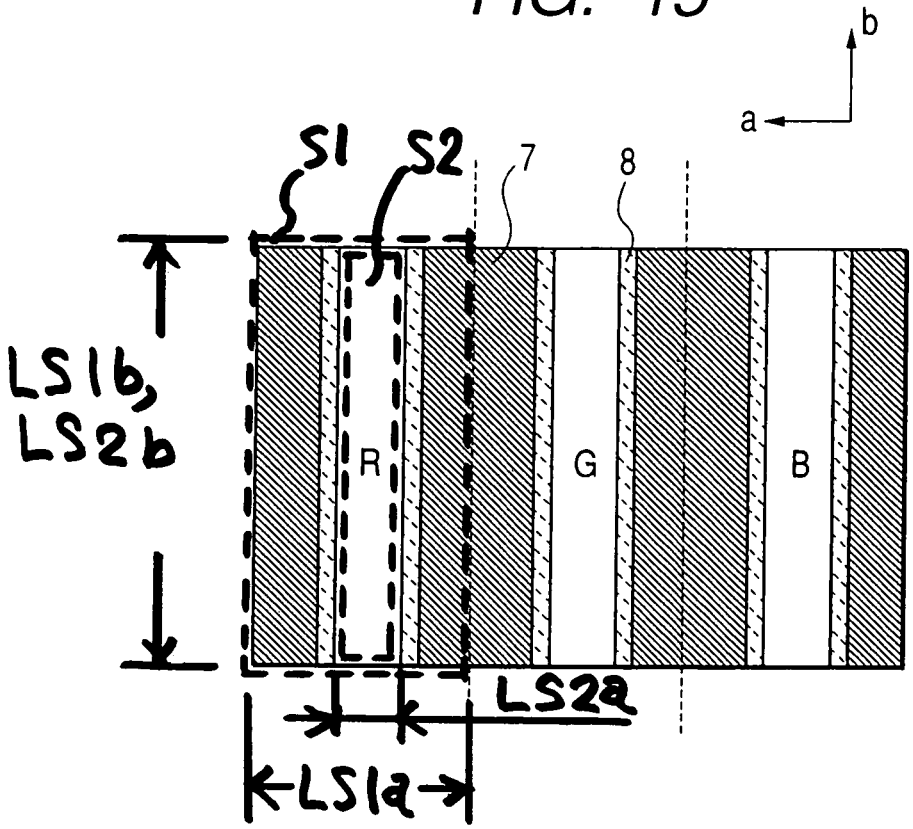
FIG. 15 is a plan view looking down at the PDP of FIG. 14.

FIGS. 14 and 15 illustrate an example which improves the light-room display contrast by selecting the width of the barrier rib plate 7 in cross section to be sufficiently large, and thereby reducing the aperture ratio. FIG. 14 is a cross-sectional view of an example of the ac vertical-discharge type PDP. In this case, although the discharge space is made smaller, since the distance between the scan electrodes 13 and the data electrodes 15 can be selected to be sufficiently large, this example is capable of providing luminance of generated light equal to or higher than that obtained by the ac surface-discharge type PDP. FIG. 15 is a plan view looking down at an arrangement of the barrier rib plate 7 and the phosphors 8 of the ac vertical-discharge type plasma panel of FIG. 14. In this case, the plasma panel having improved both the light-room display contrast and the luminous efficacy was realized by selecting the aperture ratio S2/S1 so as to satisfy the relationship $0.1<S2/S1<0.4$, and by satisfying the conditions indicated in FIG. 6(*c*).

Embodiment 3

Figure 16:
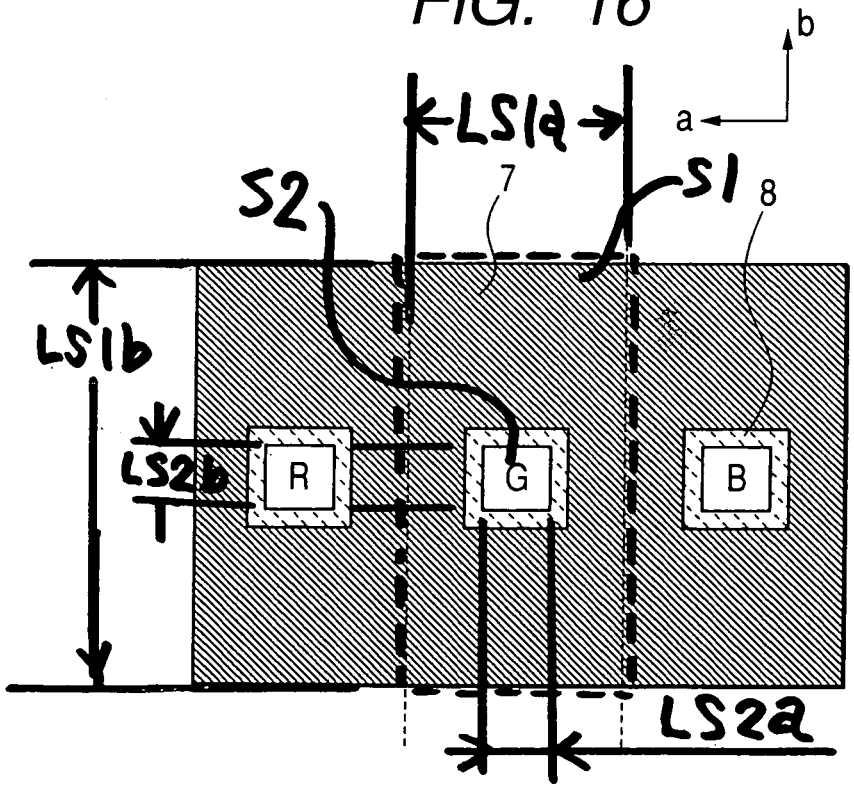
FIG. 16 is a plan view of an example of the structure of the ac vertical-discharge type PDP in accordance with still another example of the present invention.
Figure 17:
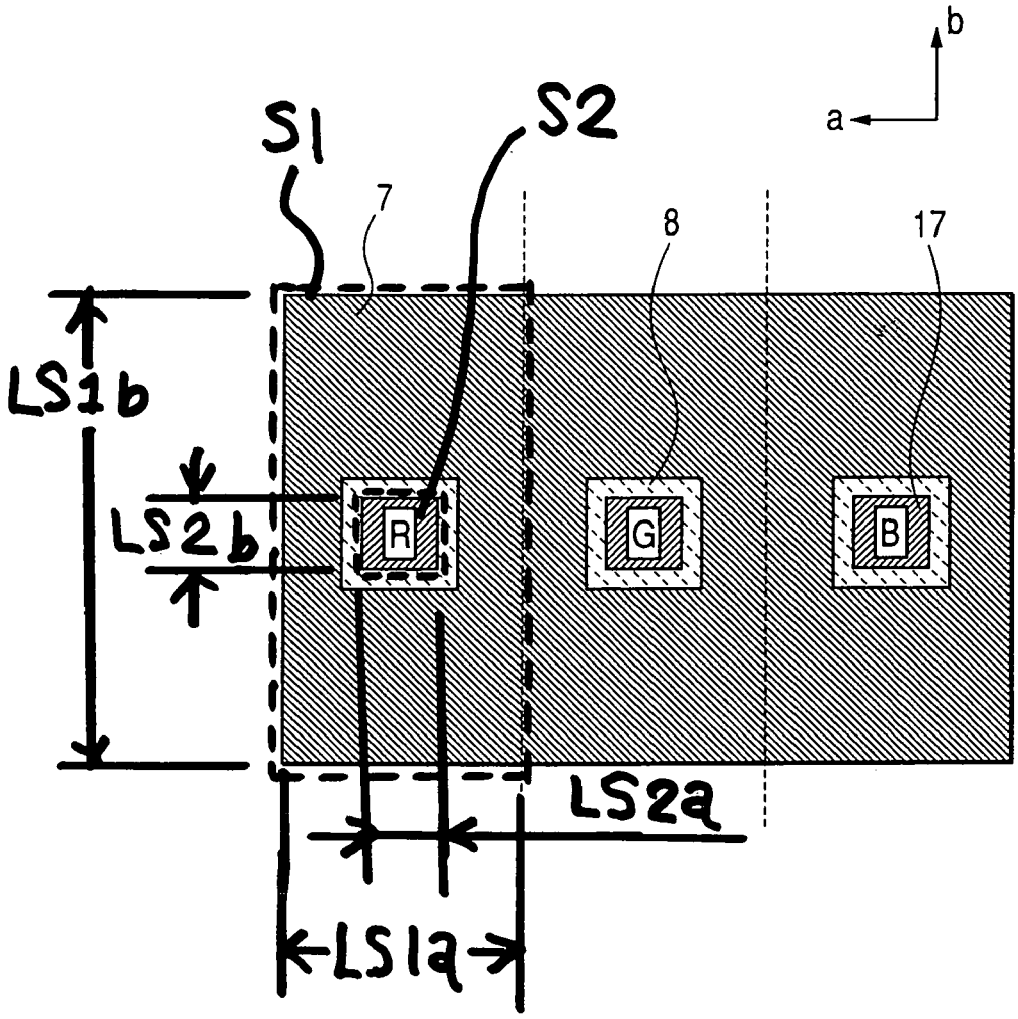
FIG. 17 is a plan view of an example of the structure of the ac vertical-discharge type PDP in accordance with still another example of the present invention.

Although the apertures provided in the barrier rib plate 7 are in the forms of stripes (or bands) in the embodiments explained in connection with FIGS. 10 to 15, the barrier rib plate 7 in the form of grids or boxes can also provides the same advantages. FIG. 16 is a plan view looking down at an embodiment employing such a barrier rib plate. In this case, the aperture ratio can be made smaller, and the light-room display contrast can be improved. FIG. 17 is a plan view of an example of a plasma panel having disposed a visible-light non-reflective layer 17 on the surfaces of the front plate 10 and the data electrodes 15 visible within the discharge cells from the viewing space in the case of FIG. 16.

Embodiment 4

Figure 18:
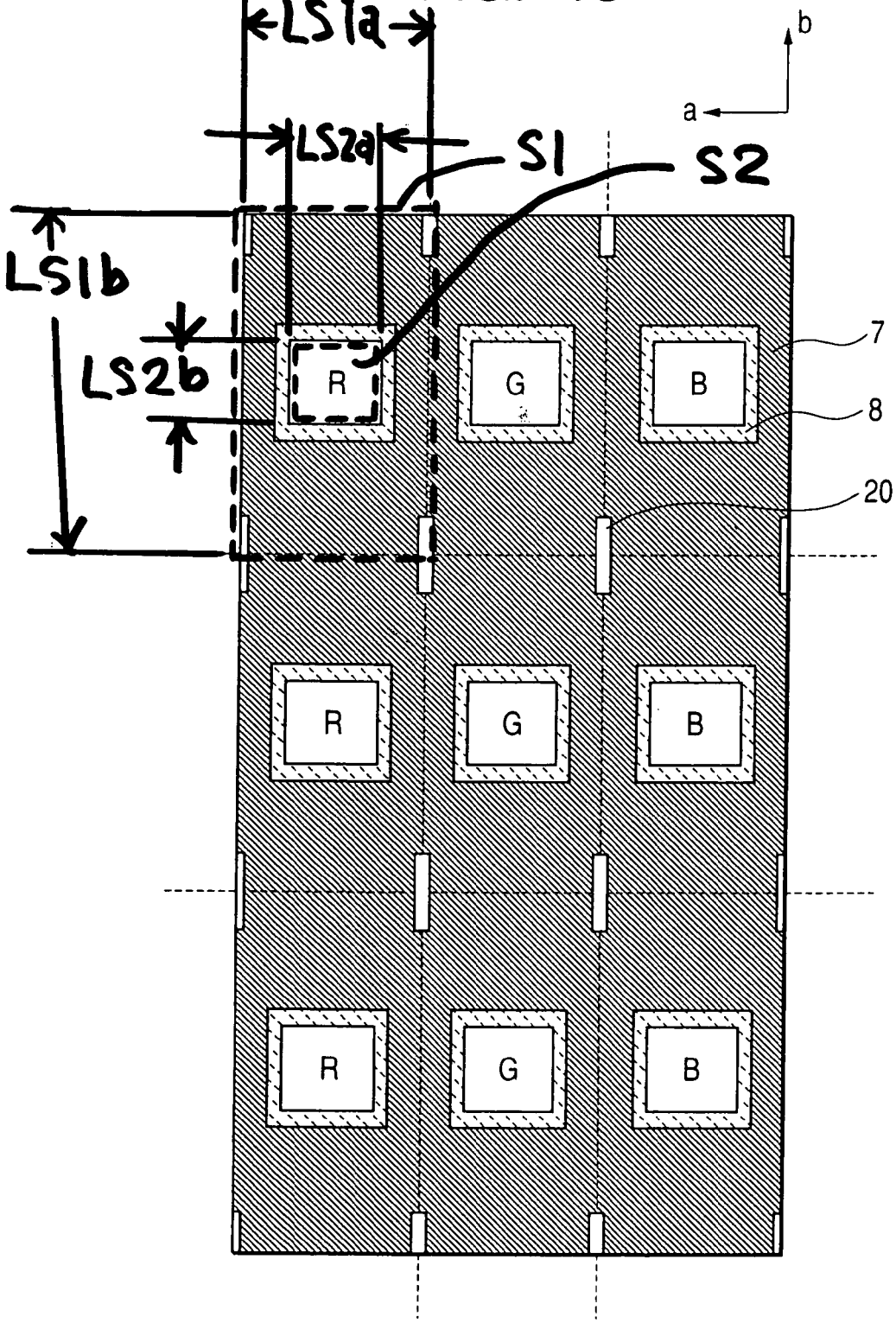
FIG. 18 is a plan view of an example of the structure of the ac vertical-discharge type PDP in accordance with still another example of the present invention.

The barrier rib plate 7 is subjected to stress during heat treatment in assembling of the plasma panel, and on rare occasions, the barrier rib plates 7, the front plate 1 or the rear plate 10 cracks. In such a case, if the coefficient of thermal expansion of material of the barrier rib plate 7 is adjusted to be 80% to 99% of those of the front plate 1 and the rear plate 10, the adjustment can prevent the cracking, and is useful for improving the yield rate. When slits 20 were made in the barrier rib plate 7 for the purpose of dispersing the stress, the cracking was prevented and the front plate 1, the barrier rib plate 7 and the rear plate 10 were stacked with higher precision. FIG. 18 illustrates the arrangement of the slits 18. The arrangement of the slits other than that shown in FIG. 18 has provided the same advantages.

Figure 19:
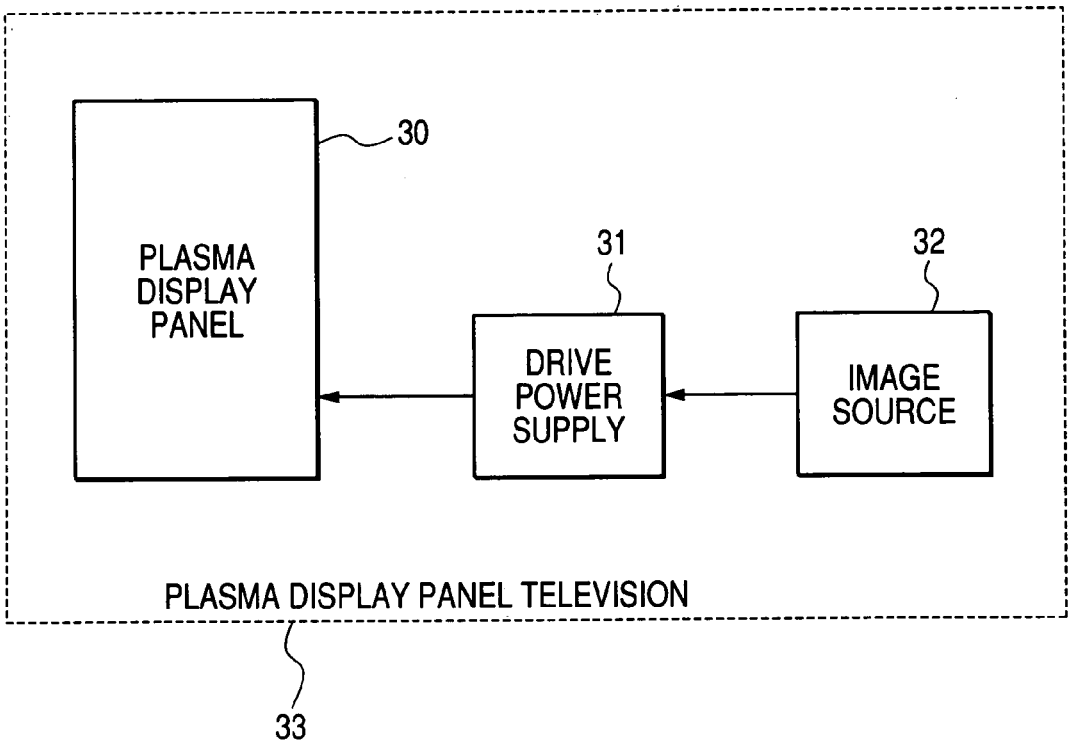
FIG. 19 is a block diagram illustrating a video display system employing the PDP of the present invention.

FIG. 19 illustrates an example of a video display system comprised of the plasma display device employing the PDP explained in the above embodiments of the present invention and an image source connected to the plasma display device. In FIG. 13, a drive power supply (also called a drive circuit) receives display signals from the image source, converts the display signals into drive signals for the PDP, and drives the PDP.

What is claimed is:

1. A plasma display panel including a plurality of discharge cells and a barrier rib layer which defines said plurality of discharge cells;

each of said plurality of discharge cells comprising:

two opposing electrodes disposed on inner surfaces of opposing front and rear substrates, respectively, for generating discharge between said front and rear substrates for forming a display;

dielectric films for covering said two opposing electrodes at least partially;

discharge gas; and a phosphor film for generating visible light by being excited by ultraviolet rays produced by said discharge of said discharge gas, wherein said barrier rib layer is fabricated in a form of a sheet separate from said front and rear substrates, is provided with a plurality of openings each of which forms a discharge space in each of said plurality of discharge cells, with walls of said plurality of openings being coated with said phosphor film, and is sandwiched between said front and rear substrates, wherein a relationship of $0.1 \leqq S2/S1 \leqq 0.4$ is satisfied, where S1 is an area of a projection of a space occupied by one of said plurality of discharge cells onto said front substrate, S2 is an area of a window portion of said front substrate through which the visible light is irradiated from said one of said plurality of discharge cells into an outside of said front substrate, and wherein relationships of $100\ \text{Torr}\times\text{mm} \leqq pd \leqq 400\ \text{Torr}\times\text{mm}$ and $0.2\ \text{mm} \leqq d$ are satisfied, where p is a pressure of said discharge gas, and d is a distance between said two opposing electrodes.

2. A plasma display panel according to claim 1, wherein said plurality of openings are in a pattern of stripes.

3. A plasma display panel according to claim 1, wherein said plurality of openings are in a pattern of stripes.

4. A plasma display panel according to claim 1, wherein said two opposing electrodes have applied therebetween a voltage of an effective value equal to or smaller than 300 V for sustaining said discharge for forming a display.

5. A plasma display panel according to claim 1, further comprising black opaque members, wherein said black opaque members are disposed between said window portions of said front substrate and on a surface of said barrier layer facing toward said front substrate.

6. A plasma display panel according to claim 2, further comprising black opaque members, wherein said black opaque members are disposed between said window portions of said front substrate and on a surface of said barrier layer facing toward said front substrate.

7. A plasma display panel according to claim 3, further comprising black opaque members, wherein said black opaque members are disposed between said window portions of said front substrate and on a surface of said barrier layer facing toward said front substrate.

8. A plasma display panel according to claim 1, wherein said walls of said plurality of openings are tilted from a normal to said front substrate.

9. A plasma display panel according to claim 2, wherein said walls of said plurality of openings are tilted from a normal to said front substrate.

10. A plasma display panel according to claim 3, wherein said walls of said plurality of openings are tilted from a normal to said front substrate.

11. A plasma display panel according to claim 1, wherein said discharge gas contains a xenon gas, and a xenon proportion aXe in said discharge gas is in a range of from 0.12 to 0.3, where said xenon proportion aXe=nXe/ng, ng is a volume particle (atom or molecule) density of said discharge gas, and nXe is a volume particle density of said Xe gas.

12. A plasma display panel according to claim 4, wherein said discharge gas contains a xenon gas, and a xenon proportion aXe in said discharge gas is in a range of from 0.12 to 0.3, where said xenon proportion aXe=nXe/ng, ng is a volume particle (atom or molecule) density of said discharge gas, and nXe is a volume particle density of said Xe gas.

13. A plasma display panel according to claim 1, wherein a coefficient of thermal expansion of material of which said barrier rib layer is comprised is in a range of from 80% to 99% of those of said front and rear substrate.

14. A plasma display panel according to claim 1, wherein said barrier rib layer is provided with at least one slit in a major surface thereof.

15. A plasma display panel according to claim 2, wherein said barrier rib layer is provided with at least one slit in a major surface thereof.

16. A plasma display panel according to claim 3, wherein said barrier rib layer is provided with at least one slit in a major surface thereof.

17. A plasma display panel according to claim 1, further comprising visible-light non-reflective layers, wherein said visible-light non-reflective layers are disposed on said rear substrate and ones of said two opposing electrodes formed on said rear substrate within said discharge cells, visible from a side of said front substrate.

18. A plasma display panel according to claim 1, further comprising ultraviolet-ray-reflective and visible-light-reflective layers, wherein said ultraviolet-ray-reflective and visible-light-reflective layers are disposed on said rear substrate and ones of said two opposing electrodes formed on said rear substrate within said discharge cells, visible from a side of said front substrate.

19. A plasma display panel according to claim 1, wherein a non-opening area reflectance is 80% or more, where a display discharge space boundary surface is a solid wall surrounding a display discharge space in which said discharge for forming a display is generated, a discharge opening area is a portion of said display discharge space boundary surface through which the visible light is irradiated into an outside of said front substrate, a non-opening area is an area of said display discharge space boundary surface other than said discharge opening area, and said non-opening area reflectance is an average surface reflectance of said non-opening area to white light.

20. A video display system employing said plasma display panel according to claim 1.

* * * * *